United States Patent [19]

Firestone

[11] Patent Number: 4,545,492

[45] Date of Patent: Oct. 8, 1985

[54] DEVICE FOR MAINTAINING DRY CONDITIONS IN VESSELS

[76] Inventor: Raymond A. Firestone, 60 Hunter Ave., Fanwood, N.J. 07023

[21] Appl. No.: 604,812

[22] Filed: Apr. 27, 1984

Related U.S. Application Data

[63] Continuation-in-part of Ser. No. 430,801, Sep. 30, 1982, abandoned.

[51] Int. Cl.[4] ..... B65D 81/24

[52] U.S. Cl. ..... 215/227; 215/228; 215/308; 206/204; 312/31.1

[58] Field of Search ..... 215/228, 227, 308; 206/204; 312/31, 31.1, 31.2

[56] References Cited

U.S. PATENT DOCUMENTS

| | | | |
|---|---|---|---|
| 649,316 | 5/1900 | Lambert | 215/308 X |
| 2,826,265 | 3/1958 | De Woody | 55/279 |
| 3,035,730 | 5/1962 | Walker et al. | 215/228 |
| 3,254,784 | 6/1966 | Lancesseur | 215/228 |
| 4,146,277 | 3/1979 | Santoro | 206/204 X |
| 4,201,296 | 5/1980 | Hrabik | 312/31 X |
| 4,287,995 | 9/1981 | Moriya | 215/228 |
| 4,350,508 | 9/1982 | Santoro et al. | 215/228 X |

FOREIGN PATENT DOCUMENTS

| | | | |
|---|---|---|---|
| 1483963 | 5/1967 | France | 215/227 |
| 1206046 | 9/1970 | United Kingdom | 215/227 |

*Primary Examiner*—Donald F. Norton
*Attorney, Agent, or Firm*—Mario A. Monaco

[57] ABSTRACT

This invention relates to a device for maintaining vessels substantially free of moisture. The device is a cap or stopper having a hollow section to contain a drying agent, a nonporous top member having at least one pinhole therein and a porous bottom member.

8 Claims, 3 Drawing Figures

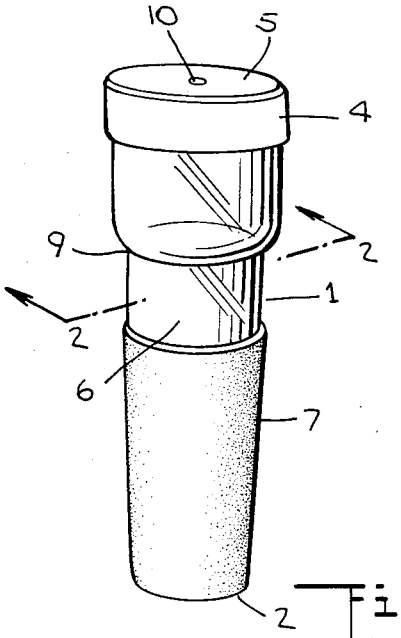
Fig. 1.
Fig. 2.
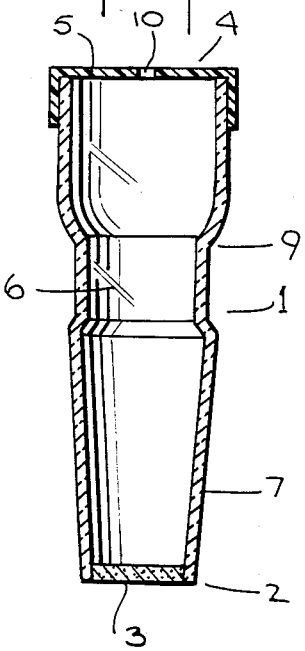
Fig. 3.
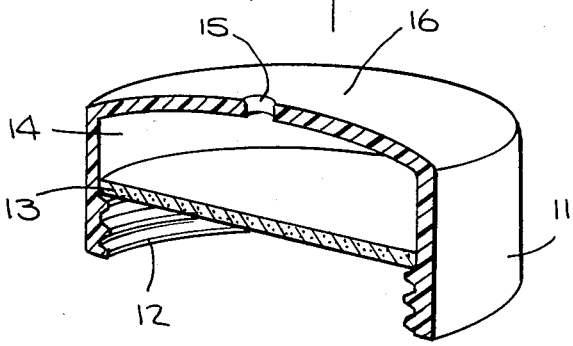

DEVICE FOR MAINTAINING DRY CONDITIONS IN VESSELS

RELATED APPLICATIONS

This application is a Continuation-in-Part of U.S. Ser. No. 430,801 filed Sept. 30, 1982, now abandoned.

BACKGROUND OF THE INVENTION

On occasions there is a need to maintain vessels substantially free of moisture. This is particularly true with vessels containing chemicals, and especially such chemicals as drugs, vitamins and minerals.

Presently, in an attempt to maintain, or obtain, such a relatively dry state in vitamin bottles for example, small packets of sealed desiccants are physically placed inside the bottle intermixed with the vitamins themselves. This method has been relatively inefficient since the packets are submerged in the contents and are unable to effectively remove the moisture in the atmosphere above. Another drawback has been removal of the packets by the users thereby eliminating their effectiveness or still worse, occasionally eating the packets by the individuals.

Chemical laboratories have a particular need for efficient removal of moisture from vessels. In such laboratories drying tube adaptors are used. The adaptor contains a stopper with an extended U-tube having a tube at its other end which contains the desiccant. This adaptor is quite inefficient. In order for the vapor to be removed from the atmosphere of the vessel, it must diffuse through the vessel into the U-tube and finally into the tube containing the desiccant. As can be noted, moisture is required to travel a long distance from the vessel to the desiccant, which makes it less likely that all of the moisture will be removed from the vessel's atmosphere.

It is therefore an object of this invention to have a device which effectively and efficiently removes moisture from the atmosphere of vessels which at the same time optionally prevents moisture from entering into the vessel.

It is a further object of this invention to provide a device which can be easily used on the vessels and wherein the desiccant is part of the device itself, and is as close as possible to the atmosphere from which the moisture is to be removed.

SUMMARY OF THE INVENTION

This invention relates to a device to remove moisture from the interior of a vessel and to prevent entry of moisture into the vessel from the exterior. The device is a cap-type cover, such as a friction-type cap, snap-type cap, screw-type cap, or a stopper or other means for covering a vessel. More particularly, the device comprises a hollow section defined at one end by a removable or unremovable top member having at least one pinhole therein, and at the other end by a removable or unremovable porous bottom member, said desiccant being between the two members (hollow portion). The pinhole(s)in the device is critical as it allows for air to pass from the atmosphere into the vessel only through the pinhole, whereas if no pinhole is present moist air readily seeps into the vessels from the side of the stopper or cap. In prior art devices, airtight seals had to be employed to prevent such flow of moist air.

DETAILS OF THE INVENTION

In its detailed aspects, the invention relates to a device to cover vessels, to remove moisture from the atmosphere within the vessels and optionally to remove moisture from the air before it enters the vessel. Two features of the device are shown in the drawings. In FIGS. 1 and 2 the device is in the form of a stopper, FIG. 1 being an isometric view of the device and FIG. 2 being a cross section. FIG. 3 shows a cross section of the screw-cap form of the device. The device may cover the vessel either at its opening or be partially inserted into the vessel, as, for example, when the vessel is a flask. In the case of a stopper 1, either or both ends of the device may be removable; one end, the end 2 facing or inserted into the vessel is made of a porous material 3, while the other end 4 is made of a nonporous material 5 and has at least one pinhole 10 therein. The portion between either end 2 and 4 comprises a hollow, or substantially hollow, area 6. The stopper device may be attached to the vessel by any known means, such as by a snap-on mechanism over the top of the vessel, or inserted snugly into the vessel, such as in the case of a stopper 7 into the top of a flask. The device may, in addition, contain a handle 9 at its nonporous end in order to facilitate the removal of the device from the vessel. If the device is of the stopper type, such as used in flasks in chemical laboratories, its size and shape may be that normally employed for stoppers of laboratory flasks.

The top portion 5, which is made of a nonporous material and may be plastic, metal or glass, may preferably be removable in order to replenish exhausted desiccant, although the top portion may be permanently sealed to the body of the stopper. This removable portion may be attached to the stopper body by any well known means—for example, it may be screwed on to the top of the device, or it may be snapped on to the top of the device. The top portion may also contain a handle member 9 such as is commonly seen in stoppers for laboratory flasks. The underportion of the device 2, which contains the porous member 3, may similarly be removable, although it is preferably permanently attached to the body of the device. The only limitation on the porous member is that the pore size be sufficiently small so as to prevent any desiccant particles or powder from passing through the porous member and into the vessel. Accordingly, the pore diameter may be anywhere from 4 to 200 microns and preferably from 10 to 100 microns, but especially from 25 to 50 microns. This porous member should be unreactive with the material in the vessel and, as such, may be made of paper, porous plastic such as polyethylene, propylene, and "Teflon", or may be made of glass or metal. The thickness of the top portion, walls of the hollow portion and underside is not critical, all that is necessary is that they be sufficiently thick to make the device sturdy for its intended use. Preferably, the porous member 3 is made of glass and is of the sintered type used in sintered glass filters. In the preferred embodiment of this invention, the porous member 3 is part of and permanently attached to the device. The other end of the device is preferably removable from the device body in order to allow fresh desiccant to be placed therein. This latter member 5 is preferably attached via snapping means and allows for the desiccant to be poured into the device through the top and then sealed. If the desiccant contains a visual indicator that tells when the desiccant is exhausted, it is advantageous for the top of this device to be transparent or translucent.

The top part 5 of the stopper contains at least one pinhole 10 through which air from the atmosphere may pass into the vessel. Although multiple pinholes may be present it is preferred to have one or two. The determining factor is the length of time the desiccant would take to dissipate because of the number of pinholes. With one or two pinholes it would take several months. The pinholes may be of the size normally made by straight pin used by seamstresses. Although the pinhole may be of any shape, it is usually circular and is about 0.01 to 0.2 mm in diameter or the equivalent area of the circular hole if it is of non-circular shape. Preferably the pinholes are from 0.05 to 0.1 mm in diameter. Naturally the more pinholes one has the smaller each should be. The pinhole(s) may be placed anywhere on the surface of the hollow portions of the stopper which is exposed to the outside atmosphere but preferably anywhere on the top of the stopper 5. In such an event, the air passing through would necessarity go through the desiccant and be dried before it entered into the body of the vessel.

In another embodiment of this invention (see FIG. 3) the device may be a screw cap 11. The screw portion (threads) 12 of the cap is the same as that normally used for covers in screw-type bottles, such as bottles used for vitamins and minerals sold to the general public. The screw cap, for the purposes of this invention, should contain a sufficient space 14 above the end of the screw portion or threads 12 of the cap in order to allow room for sufficient desiccant. This space may be a depth of anywhere from about one-eighth of an inch to about two inches or more. Preferably, the depth is about one-half inch. The top portion 16 of the screw cap has one or more pinholes 15 therein. These pinholes are the same as described for the stopper with respect to number, size and location, the screw cap may be made of any type material, such as metal, glass or plastic. The porous member 13 of the screw cap device of this invention may similarly be made of materials such as previously described for the stopper-type device of this invention. The space above or near the upper portion of the threads 12 of the screw cap contains the porous member 13. Its pore size should also be the same as previously described. The porous member may be permanently attached to the cap or removably attached, but preferably removably attached. It may be attached onto the inside portion of the cap by means of clips, friction, or other common means for maintaining two members in a stationary position.

The desiccant used in this invention may be any drying agent, which is any hygroscopic solid that does not react with the contents of the vessel. The only requirement of the desiccant is that it be capable of absorbing moisture. Such desiccants may be "drierite" ($CaSO_4$), molecular sieves, calcium chloride, magnesium sulfate, sodium sulfate, magnesium chlorate, silica gel and the like.

What is claimed is:

1. A cover device for maintaining dry conditions in vessels which comprises:

(a) a member made of a porous material;

(b) a member made of a non-porous material having at least one pinhole therein wherein the pinhole has an equivalent area as if it had a diameter of from 0.01 to 0.2 mm.;

(c) a hollow portion between the members (a) and (b); and (d) means on the cover device for attaching said cover device to a vessel such that the member (a) communicates with the interior of the vessel.

2. A cover device of claim 1 wherein said hollow portion contains a desiccant.

3. A cover device of claims 1 or 2 wherein the member made of porous material is permanently attached to said cover device.

4. A cover device of claim 3 wherein said member made of porous material is sintered glass.

5. A cover device of claim 4 wherein the member made of non-porous material is removably attached to said cover device.

6. The cover device of claim 1 wherein the pinhole(s) are circular and have a diameter of from 0.01 mm to 0.2 mm.

7. A cover device having an underside and a top side, in the form of a glass stopper comprising (a) a sintered glass on the underside of said cover device;

(b) a removable topside made of non-porous material on the opposite end of said underside, said topside having one or more pinholes therein, wherein the pinhole has an equivalent area as if it had a diameter of from 0.01 to 0.2 mm.; and (c) a hollow center portion between topside made of non-porous material and the sintered glass underside.

8. A screw cap having threads therein on one end, a top portion at the other end and a hollow portion in between comprising;

(a) member made of porous material near the end of the thread closest to the hollow portion separating said top portion from the threads; and (b) one or more pinholes on the top portion of said cap, said pinhole having an equivalent area as if it had a diameter of from 0.01 to 0.2 mm.

* * * * *